US006305549B1

(12) United States Patent
Riddle et al.

(10) Patent No.: US 6,305,549 B1
(45) Date of Patent: Oct. 23, 2001

(54) VIBRATING SCREEN ASSEMBLY OF DISSIMILAR MATERIALS

(75) Inventors: Russell Allen Riddle, Chelsea; Terry L. Baltzer; Bill Howard, both of Tulsa, all of OK (US)

(73) Assignee: Southwestern Wire Cloth, Inc., Broken Arrow, OK (US)

( * ) Notice: Subject to any disclaimer, the term of this patent is extended or adjusted under 35 U.S.C. 154(b) by 0 days.

(21) Appl. No.: 09/347,672

(22) Filed: Jul. 6, 1999

(51) Int. Cl.[7] ..... B07B 1/48; B07B 1/49

(52) U.S. Cl. ..... 209/403; 209/401; 209/405; 209/44

(58) Field of Search ..... 209/401, 403, 209/405, 413, 411, 408, 404, 409, 412

(56) References Cited

U.S. PATENT DOCUMENTS

| | | | |
|---|---|---|---|
| 1,009,069 | 11/1911 | Hunnicutt . | |
| 1,147,279 | 7/1915 | Sweetland . | |
| 1,886,173 | 11/1932 | Flint . | |
| 2,088,313 | 7/1937 | Wettlaufer | 209/403 |
| 2,271,900 | 2/1942 | Mowbray | 209/403 |
| 2,335,084 | 11/1943 | Rice | 209/403 |
| 2,576,794 | 11/1951 | Jost et al. | 209/405 |
| 2,723,032 | 11/1955 | Gisler et al. | 209/401 |
| 2,870,910 | 1/1959 | Wehner | 209/396 |
| 2,902,165 | 9/1959 | Imershein | 210/486 |
| 2,959,285 | 11/1960 | Tonjes et al. | 209/319 |
| 2,985,303 | 5/1961 | Wright | 209/405 |
| 3,012,674 | 12/1961 | Hoppe | 209/401 |
| 3,508,649 | 4/1970 | Kahane et al. | 209/323 |
| 3,970,549 | 7/1976 | Ennis et al. | 209/341 |
| 4,033,865 | 7/1977 | Derrick, Jr. | 209/275 |
| 4,380,494 | 4/1983 | Wilson | 209/319 |
| 4,668,394 | 5/1987 | Badolato et al. | 210/314 |
| 4,728,422 | 3/1988 | Bailey | 210/314 |
| 4,840,728 | 6/1989 | Connolly et al. | 209/405 |
| 4,886,608 * | 12/1989 | Cook | 210/785 |
| 4,950,403 * | 8/1990 | Hauff et al. | 210/486 |
| 4,968,366 * | 11/1990 | Hukki et al. | 156/153 |
| 5,137,622 | 8/1992 | Souter | 209/403 |
| 5,199,574 | 4/1993 | Hollyfield, Jr. et al. | 209/315 |
| 5,221,008 | 6/1993 | Derrick, Jr. et al. | 209/268 |
| 5,248,043 | 9/1993 | Dorn | 209/399 |
| 5,256,291 | 10/1993 | Cagle | 210/499 |
| 5,361,476 | 11/1994 | Leopold | 29/417 |
| 5,385,669 | 1/1995 | Leone, Sr. | 210/488 |
| 5,392,925 | 2/1995 | Seyffert | 209/405 |
| 5,417,793 | 5/1995 | Bakula | 156/308.2 |
| 5,417,859 | 5/1995 | Bakula | 210/388 |
| 5,538,139 | 7/1996 | Keller | 209/382 |
| 5,615,776 * | 4/1997 | Bjorklund et al. | 209/403 |
| 5,636,749 | 6/1997 | Wojciechowski | 209/403 |
| 5,690,826 | 11/1997 | Cravello | 210/384 |
| 5,816,413 * | 10/1998 | Boccabella et al. | 209/399 |
| 5,819,952 * | 10/1998 | Cook et al. | 209/400 |
| 5,851,393 * | 12/1998 | Carr et al. | 210/489 |
| 5,915,566 * | 6/1999 | Senapati | 209/365.1 |
| 5,927,511 * | 7/1999 | Riddle et al. | 209/405 |
| 5,967,336 * | 10/1999 | Baltzer et al. | 209/403 |
| 6,032,806 * | 3/2000 | Leone et al. | 209/402 |
| 6,053,329 * | 4/2000 | Ballman | 209/405 |
| 6,070,736 * | 6/2000 | Ballman et al. | 209/325 |
| 6,220,448 * | 4/2001 | Bakula et al. | 209/392 |

FOREIGN PATENT DOCUMENTS

| | | | |
|---|---|---|---|
| 0032436 | 7/1981 | (EP) | B07B/1/46 |
| 0169698 | 1/1986 | (EP) | B07B/1/46 |
| 2092917 | 8/1982 | (GB) | B07B/1/46 |
| 2276572 | 5/1994 | (GB) . | |

* cited by examiner

*Primary Examiner*—Donald P. Walsh
*Assistant Examiner*—Daniel K. Schlak
(74) *Attorney, Agent, or Firm*—Head, Johnson & Kachigian

(57) ABSTRACT

A vibrating screen assembly of dissimilar materials. A frame is composed of a first material having a coefficient of thermal expansion. At least one screen cloth is composed of a second material. A ratio of the coefficient of thermal expansion first material to the coefficient of thermal expansion of the second material is greater than one.

19 Claims, 4 Drawing Sheets

VIBRATING SCREEN ASSEMBLY OF DISSIMILAR MATERIALS

BACKGROUND OF THE INVENTION

1. Field of the Invention

The present invention relates to a vibrating screen assembly composed of dissimilar materials which is used with a vibrating machine for separating solids and fluids.

2. Prior Art

Vibrating screen assemblies are used on vibrating machines or shakers to separate solid material from liquids and fine solid particles. A frame for the screen assembly may include opposed sides and ends and may include various cross-members and rods. The frame for the screen assembly is removably attached to the vibrating shaker and the screen assembly is vibrated at high frequency by a reciprocating motor.

The dynamic forces brought about by vibration separates the liquid and particles smaller than the pore size of the smallest screen layer. The screen assembly is subject to tremendous stress by virtue of the machinery vibrating it and is subject to stress from the weight of the material to be separated on the top layer of the screen.

While it is possible to replace a screen assembly, frequent replacement entails added cost and down-time for the machinery. Accordingly, extending the life of a screen assembly is highly desirable.

It is advantageous to retain the screen cloth or screen cloths in as tight a condition to the frame as possible. Slackness in the screen cloth or screen cloths may cause undesirable flapping of the screen cloth or cloths. Slackness also may permit the shute strands of the screen cloth to move in relation to the warp strands. This may influence the effectiveness of the screen cloth to filter. It is known that tensioning the screen or screens to the frame will enhance the life of the screen assembly. Indeed, screen tension is believed to be one of the greatest factors to determine the screen life. Accordingly, in some applications, the screen cloth or screen cloths are tensioned prior to being attached and bonded to the frame.

Vibrating screen assemblies may be used to screen materials which contain a heated slurry. In one such application, water is used as a slurry in order to screen calcium carbonate solids. The slurry mixture which is deposited on the top of the screen assembly may be approximately 190° F. and may range up to 250° F.

It is known that as the temperature of solid (and other) materials increases, the average separation of the molecules increases. Accordingly, the materials will expand when heated. The materials that comprise the vibrating screen assembly each have coefficients of thermal expansion. The coefficients of thermal expansion for some common materials are as follows:

| MATERIAL | CELSIUS SCALE $\frac{m}{m^\circ C.} \times 10^{-6}$ | FAHRENHEIT SCALE $\frac{in}{in^\circ F.} \times 10^{-6}$ |
|---|---|---|
| Aluminum | 23.9 | 13.3 |
| Brass | 18.7 | 10.4 |
| Carbon Steel | 10.8 | 6.0 |
| Cast Iron | 10.6 | 5.9 |
| Magnesium | 25.2 | 14.0 |

-continued

| MATERIAL | CELSIUS SCALE $\frac{m}{m^\circ C.} \times 10^{-6}$ | FAHRENHEIT SCALE $\frac{in}{in^\circ F.} \times 10^{-6}$ |
|---|---|---|
| Stainless Steel | 17.3 | 9.6 |
| ABS | 95 | 52 |
| Glass-Filled Nylon | 81 | 45 |
| Glass-Filled Polypropylene | 37 | 21 |

Each time the slurry and the materials to be separated are deposited on the screen assembly, heat is transferred to the frame and the screen cloths. The heat transfer causes the screen cloth and the frame to expand. If the frame is caused to expand greater than the screen cloth, the effect will be for the screen cloth or cloths to be tightened.

It is also believed that at the start-up of the screening operation, the heated slurry materials to be screened are deposited on the center of the screen assembly causing the cross-members and rods to be heated quicker than the sides and ends of the frame.

Accordingly, it is a principal object and purpose of the present invention to provide a screen assembly wherein the frame and screen cloth or cloths are composed of different materials and wherein the frame has a greater coefficient of thermal expansion than the screen cloth or screen cloths.

It is a further object and purpose of the present invention to provide a vibrating screen assembly which is self-tensioning when utilized to screen materials above the ambient temperature at which the screen assembly is fabricated.

SUMMARY OF THE INVENTION

The present invention provides a vibrating screen assembly composed of dissimilar materials for use with a vibrating machine or shaker. The screen assembly includes a frame which is removably held in the vibrating machine or shaker. In a preferred embodiment, the frame is composed of aluminum or aluminum alloy and includes tubular sides which are opposed and parallel to each other. The frame also includes a pair of tubular ends which are likewise opposed and parallel to each other. At each joint where the tubular sides meet the tubular ends, a corner gusset is provided. Extending between the tubular sides are a plurality of tubular cross members. Extending between the opposed tubular ends and extending through the cross members are a pair of solid aluminum rods. The solid aluminum rods are parallel to each other and parallel to the tubular sides.

In the present embodiment, two screen cloths are composed of stainless steel and are woven from a plurality of individual strands. A lower screen cloth is parallel to and adjacent an upper screen cloth. The screen cloths are bonded to the metal frame by high temperature adhesive, such as epoxy. Also, a bead of initially liquid urethane is placed on each of the cross members and is also placed on the frame sides and frame ends to help dampen the movement of the screen cloths during operation against the frame.

The ratio of coefficient of thermal expansion of the aluminum frame is greater than the coefficient of thermal expansion of the stainless steel screen cloths.

To assemble the vibrating screen assembly, the pair of tubular sides is welded to the pair of tubular ends with a corner gusset joining each side and end connection. The plurality of tubular cross members extend between the tubular sides and are welded thereto. The pair of solid rods extend between the tubular ends and pass through each of the cross members.

A high temperature adhesive, such as an initially liquid epoxy, is placed on one side of the frame, on each of the sides and each of the ends. Thereafter, a bead of initially liquid urethane or other dampening material may be placed adjacent the high temperature adhesive on the frame sides and ends and also covers each of the cross members.

The pair of screen cloths, having an outside dimension greater than the frame, are brought together and clamped or held in a jig which places the screen cloths under tension. The combined pair of screen cloths and accompanying jig are then lowered onto the epoxy and urethane. The screen cloths are held in the tensioned position on the frame until the adhesive has cured.

It has been found that the present invention will provide a self tensioning screen assembly when put in use to screen materials at temperatures above that at which it has been assembled.

DETAILED DESCRIPTION OF THE PREFERRED EMBODIMENTS

Figure 1:
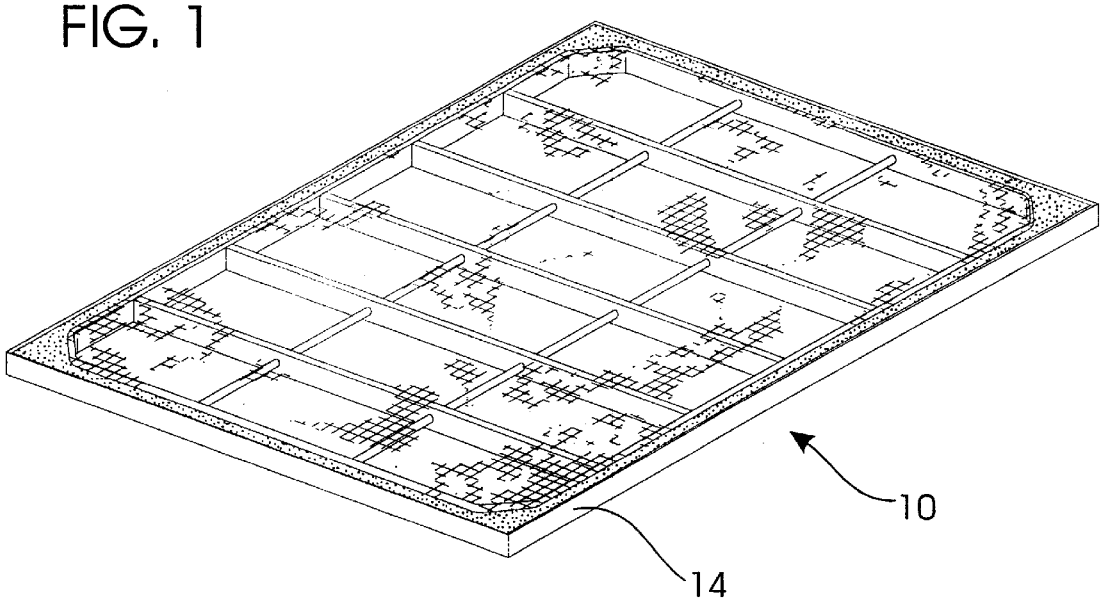
FIG. 1 is a top view of a vibrating screen assembly composed of dissimilar materials which is constructed in accordance with the present invention.
Figure 2:
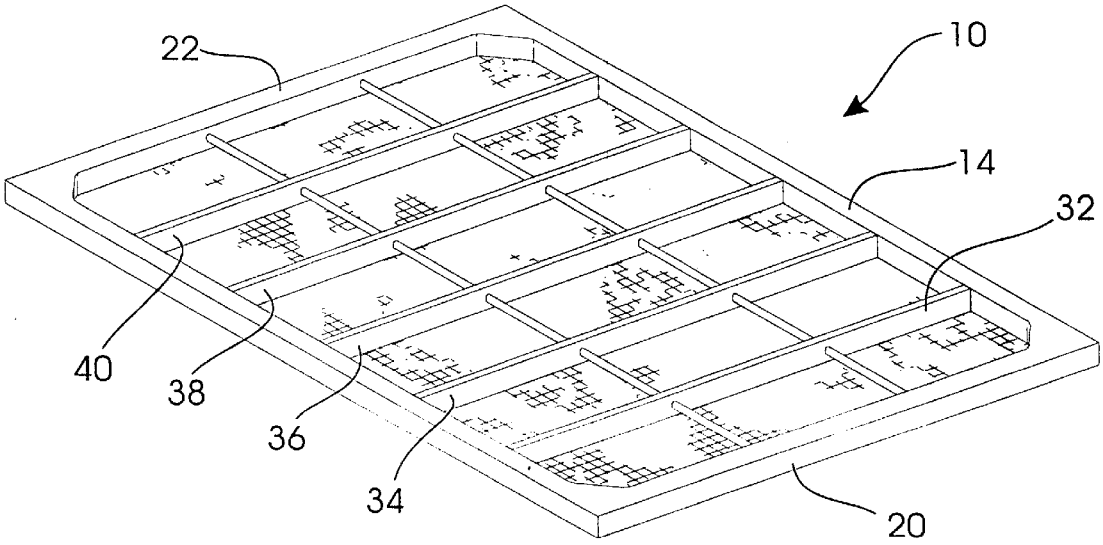
FIG. 2 is a bottom, perspective view of the vibrating screen assembly shown in FIG. 1.

Referring to the drawings in detail, FIG. 1 is a top, perspective view of a vibrating screen assembly 10 composed of dissimilar materials constructed in accordance with the present invention and FIG. 2 is a bottom, perspective view of the vibrating screen assembly 10.

The screen assembly 10 is composed of and assembled from a number of discreet components as will be described in detail below. In the present preferred embodiment, the screen assembly 10 is composed of a pair of wire screen cloths which are affixed and adhesively secured to a frame 14. The frame 14 supports the screen cloth or screen cloths. The screen assembly 10 will be held in place in a vibrating machine or shaker in a variety of ways, such as with clamps or hydraulic bladders (not shown). In some applications, a pair or more of screen assemblies are mounted in the vibrating machine. As the machine vibrates, it will vibrate the screen assembly.

It will be understood that at least one screen cloth is required to practice the teachings of the present invention but a plurality of screen cloths may be utilized.

In the present embodiment, the screen cloth or cloths are each composed of stainless steel and woven from a plurality of individual wire strands as is well known in the art. An upper or top most screen cloth will have a finer cut point than the lower screen although the screen size is a matter of choice.

Figure 3:
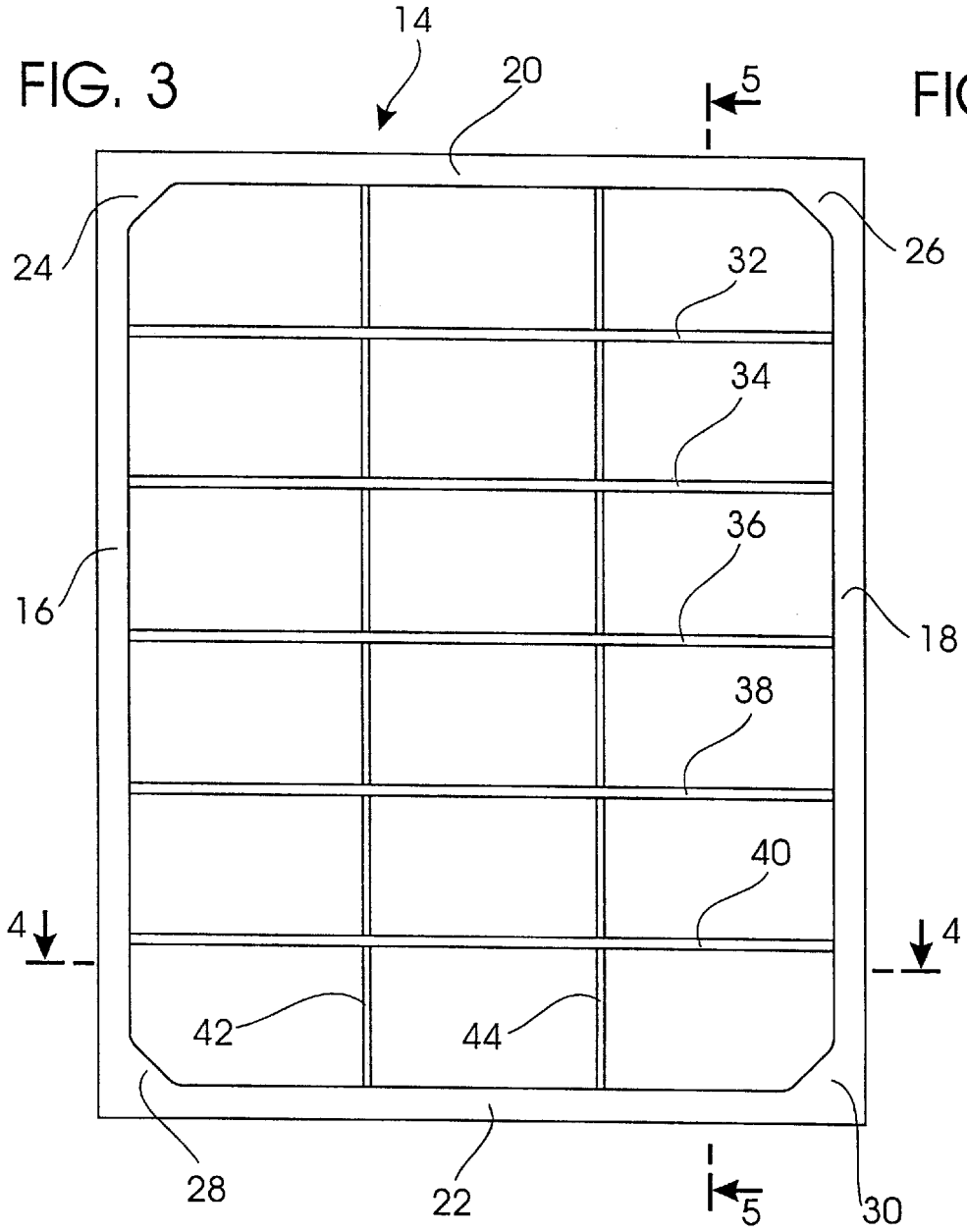
FIG. 3 is a top view of a frame which is a part of the vibrating screen assembly shown in FIG. 1.
Figure 5:
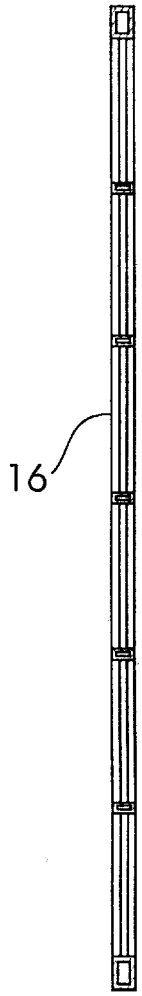
FIG. 5 is a sectional view taken along section line 5—5 of FIG. 3.
Figure 4:
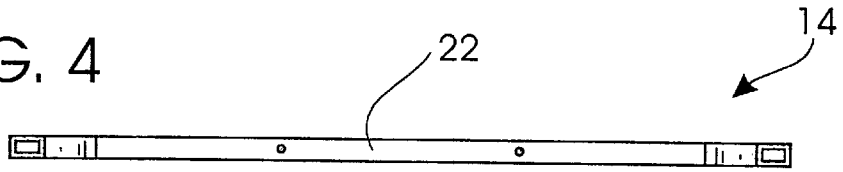
FIG. 4 is a sectional view taken along section line 4—4 of FIG. 3.

FIGS. 3, 4, and 5 illustrate the frame 14 apart from the rest of the screen assembly 10.

The frame 14 is composed of aluminum or an aluminum alloy, containing primarily aluminum and various other additives. For example, an aluminum alloy may contain 98% by weight of aluminum and small amounts of zinc, titanium, iron and other components. The frame 14 includes a pair of tubular sides 16 and 18 which are opposed and parallel to each other. The frame 14 also includes a pair of tubular ends 20 and 22 which are likewise opposed and parallel to each other. At each joint where the tubular sides 16 and 18 meet the tubular ends 20 and 22, an aluminum corner gusset 24, 26, 28, and 30 is provided.

Extending between the sides 16 and 18, are a plurality of tubular cross members 32, 34, 36, 38 and 40. The sides, ends and cross members may be constructed from lengths of the same hollow tubular aluminum cut to size and welded together. Extending between the opposed tubular ends 20 and 22 and extending through the cross members are a pair of solid aluminum rods 42 and 44. The aluminum rods are parallel to each other and parallel to the tubular sides 16 and 18.

The number of rods and the number of cross-members are a matter of choice although in the present embodiment, the distance between the cross members and the distance between the rods forms a ratio between 0.10 to 1.0.

In summary, all of the elements of the frame 14 are composed of aluminum or aluminum alloy.

Figure 6:
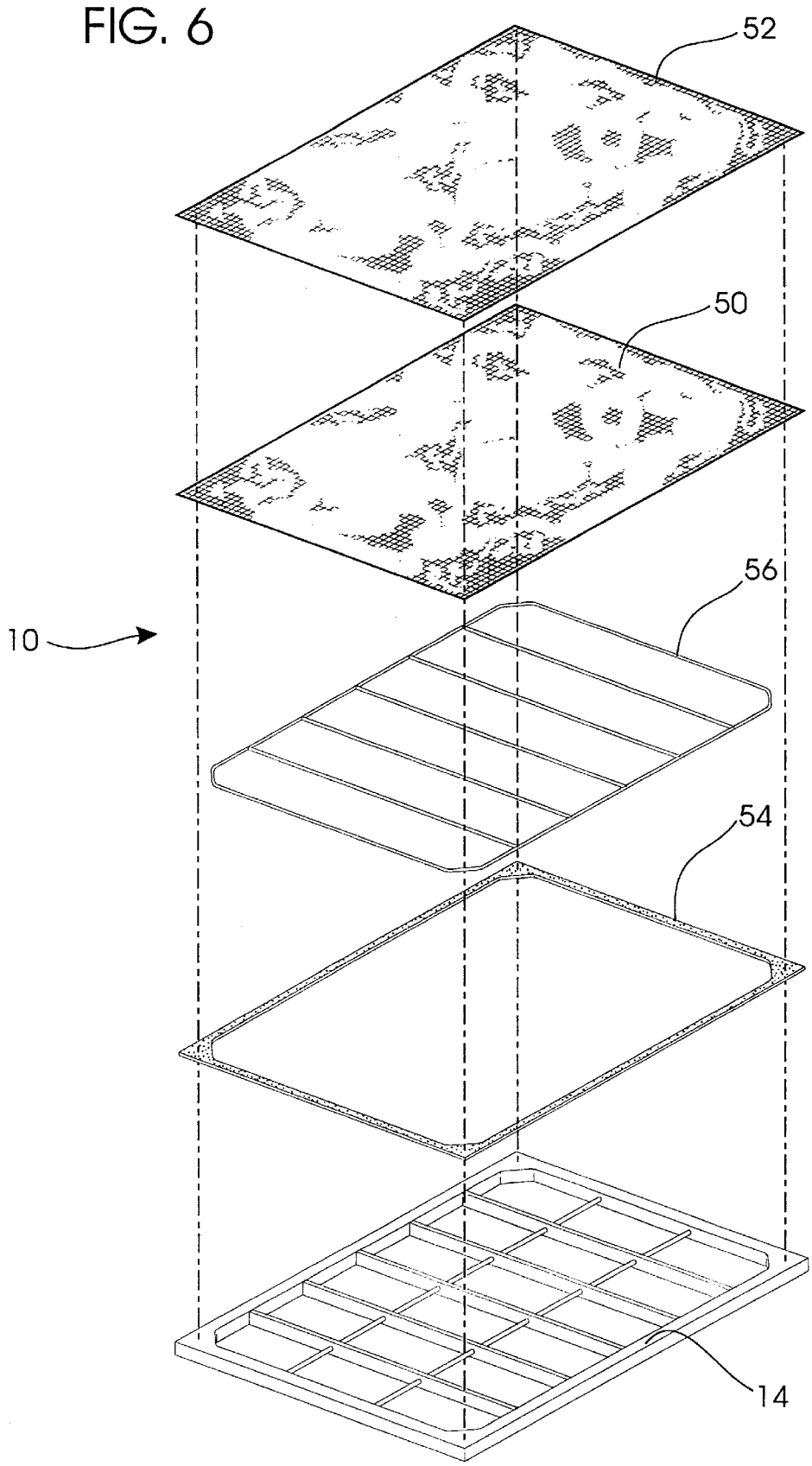
FIG. 6 is an exploded view of the vibrating screen assembly shown in FIG. 1.

FIG. 6 is an exploded view of the vibrating screen assembly 10 of the present invention. In addition to the frame 14 described above, the screen assembly 10 includes a lower screen cloth 50 and an upper screen cloth 52. In the present embodiment, the upper screen cloth has a finer pore size than the lower screen cloth 50. Each of the screen cloth layers is composed of stainless steel.

The screen cloths 50 and 52 are bonded to the metal frame 14 by a high temperature adhesive, in the present invention by an initially liquid epoxy, shown as reference numeral 54. Also a bead of initially liquid urethane 56 is placed on each of the cross members 32, 34, 36, 38 and 40 and placed on the frame sides 16 and 18 and ends 20, 22 to help dampen the movement of the screen cloths. It will, thus, be seen that the screen cloths are composed of stainless steel threads and the frame, including its tubular sides, tubular ends, corner gussets, cross members and tubular rods, is composed of aluminum. The ratio of the coefficient of thermal expansion of the frame composed of aluminum is greater than the coefficient of thermal expansion of the screen cloths are composed of stainless steel.

In order to assemble the vibrating screen assembly 10 of the present invention, a pair of hollow tubular sides is welded to a pair of hollow tubular ends with a corner gusset joining each side and end connection. A plurality of tubular cross members extend between the sides 16 and 18 and are welded thereto. The pair of solid rods 42 and 40 extend between the ends and pass through each of the cross members.

Once the aluminum frame 14 has been assembled a bead of urethane 56 or other dampening material may be placed adjacent the high temperature adhesive on the frame 14 and on each of the cross members. High temperature adhesive, such as an initially liquid epoxy 54 is placed on one side of the frame on the sides and ends. Epoxy has been chosen in the present application for its ability to stand up to high temperature. The urethane also has adhesive properties but is primarily used as a dampening material.

The pair of screen cloths 50 and 52 have an outside dimension greater than the frame. The pair of screen cloths are brought together and held in a jig (not shown). The jig causes the edges of the screen cloth to be under tension. In the present example, the screen cloths are tensioned at approximately 40 newtons per centimeter although other levels of tension may be applied. The combined pair of screen cloths 50 and 52 and accompanying jig are then lowered onto the epoxy and urethane resting on the frame. The epoxy and urethane will join with the screen cloths and will pass into openings in the screen cloths. The screen cloths are held in the tensioned position on the frame until the adhesive has cured. Thereafter, the screen cloths are trimmed along the edges of the frame.

Figure 7:
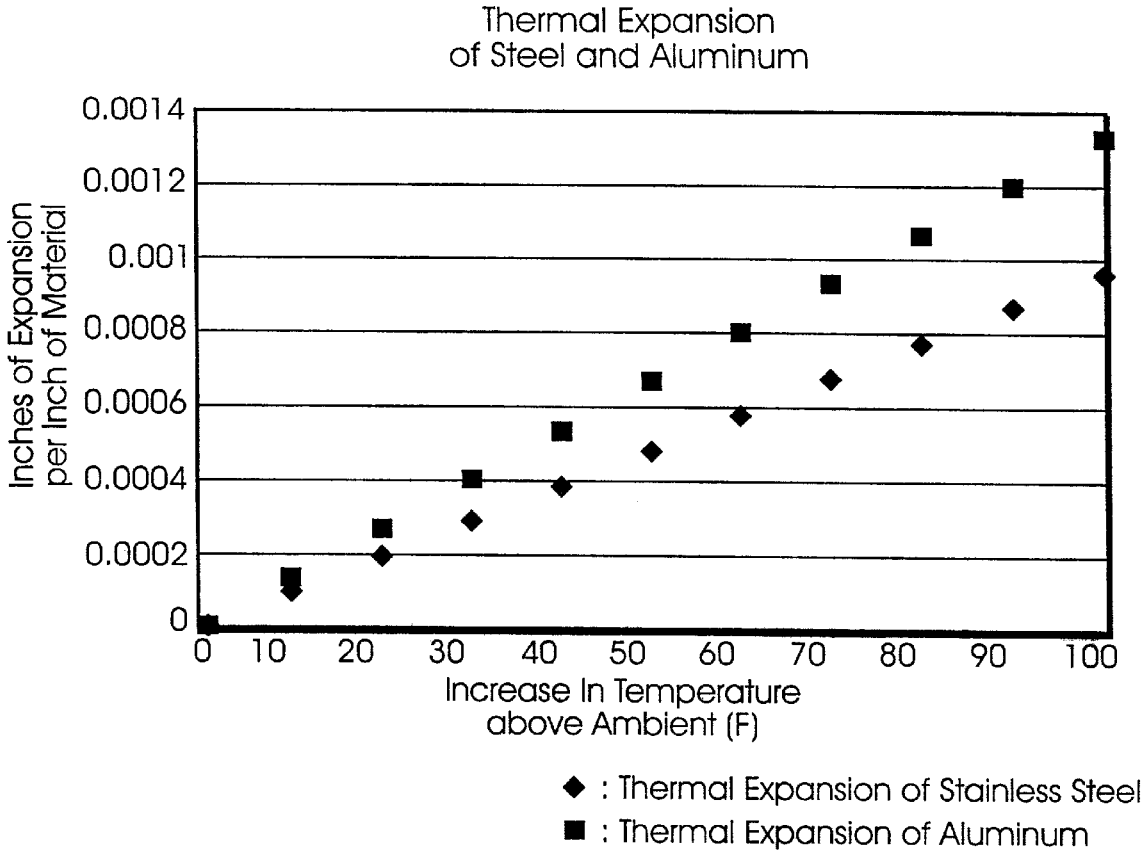
FIG. 7 is a graph showing the coefficients of thermal expansion of both aluminum and stainless steel.

FIG. 7 illustrates a graph of the thermal expansion of both stainless steel and aluminum. While the aluminum may be an alloy, since it is primarily aluminum, the coefficient of thermal expansion of aluminum is used herein. The X-axis shows the increase in temperature in Fahrenheit above the initial cure temperature. The Y-axis shows the expansion in inches per inch of material. It may be observed that the greater the temperature above the ambient cure temperature, the greater that the aluminum will expand in relation to the stainless steel. While the aluminum frame 14 will expand in all directions, the linear expansion of the frame is pertinent to the present invention.

Figure 8:
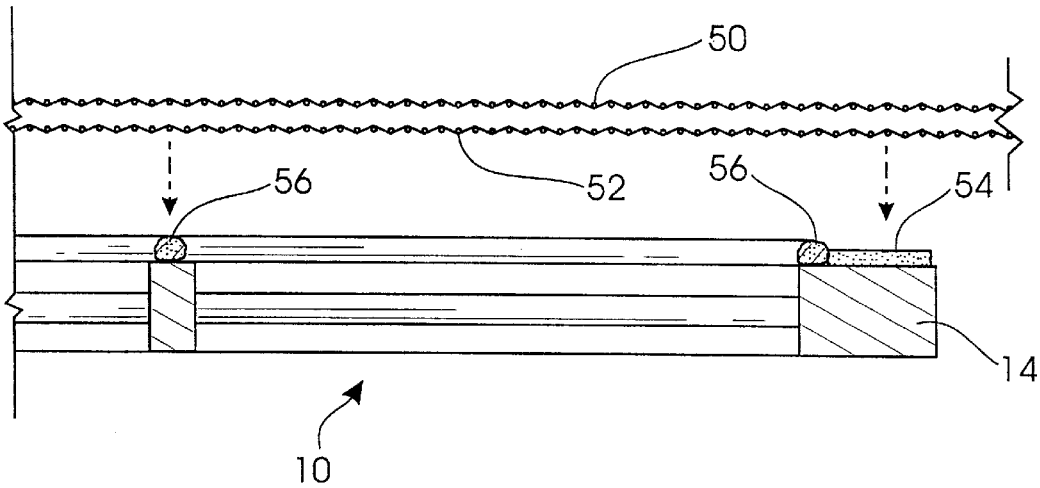
FIG. 8 is a partial, exploded view of the vibrating screen assembly shown in FIG. 1.

FIG. 8 shows the screen cloths 50 and 52 apart from the frame prior to being brought down on top of the frame 14 and the epoxy 54 and urethane 56.

It has been found that the present invention will provide a self tensioning screen assembly when used in temperatures above that at which it was fabricated. The thermal expansion of the aluminum frame exceeds that of the stainless steel screen or screens. In one known use, a slurry containing water and calcium carbonate at approximately 190° F. requires separation. With the heated slurry to be screened on the screen assembly, the temperature of the metals will increase. The aluminum in the frame will expand more than the stainless steel in the screen cloths. This results in greater linear expansion of the frame 14 than the screen. The effect is to stretch the screen cloths to a greater degree than if metals with similar coefficients of thermal expansion had been used for both the screen cloths and the frame. Accordingly, the objectives of the present invention are achieved by using a frame material with a coefficient of thermal expansion greater than that of the screen mesh material. It will be appreciated that the frame and screen cloths may be fabricated from other materials as long as the coefficient of thermal expansion of the frame is greater than the coefficient of thermal expansion of the screen cloths.

A further objective is achieved by use of the present invention during operation start up. During the initial stages of use, when the heated slurry to be separated is placed on the screen assembly 10, it is known that the frame 14 will tend to expand in the middle initially. Thus, the cross members and the rods will be influenced by the temperature prior to the sides and ends of the frame. As the screen assembly 10 warms up to its operating temperature, the ultimate temperature from the influence of the heated slurry, the rods 42 and 44 will expand quicker than the cross members 32, 34, 36, 3 8, and 40 since they are directly in the path of the material falling through the screen cloths. The cross members will heat up more slowly since they are covered with a urethane 56. As the tubular rods 42 and 44 expand, they will increase in length as well. At the same time, the tubular sides and tubular ends of the frame have not yet reached operating temperature and will reach operating temperature after a given time period. Because of this initial unequal expansion, the effect is to create an area of increased tension until the rest of the frame reaches operating temperature. To achieve the desired uniform transient thermal expansion, the ratio of the length of the solid rods (the distance from cross member to cross member) to the length of the cross members (the distance from rod to rod) will equal approximately 0.635. It has been found that a range of ratios from 0.1 to 1.0 would achieve the purposes of the present invention.

It has been found that the screen cloths 50 and 52 are self tensioned during operation, that the screen assembly is less prone to wearing and tearing, and the operating life of the screen assembly has doubled with use of the present invention.

Whereas, the present invention has been described in relation to the drawings attached hereto, it should be understood that other and further modifications, apart from those shown or suggested herein, may be made within the spirit and scope of this invention.

What is claimed is:

1. A vibrating screen assembly, which comprises:

at least one screen cloth;

a metal frame of different material from said screen cloth, said screen cloth bonded to said metal frame and wherein said metal frame has a coefficient of thermal expansion greater than a coefficient of thermal expansion of said screen cloth;

wherein said frame includes a pair of tubular sides, a pair of tubular ends, a plurality of tubular cross members extending between said sides, wherein said cross members are connected together by a plurality of rods; and wherein the distance between said cross members and the distance between said rods forms a ratio from 0.1 to 1.0.

2. A vibrating screen assembly as set forth in claim 1 wherein said screen cloth is stainless steel.

3. A vibrating screen assembly as set forth in claim 1 wherein said metal frame is aluminum or aluminum alloy.

4. A vibrating screen assembly as set forth in claim 1 wherein corner gussets join said sides and said ends.

5. A vibrating screen assembly as set forth in claim 1 wherein the distance between said cross members and the distance between said rods forms a ratio of 0.635.

6. A vibrating screen assembly as set forth in claim 1 wherein said screen cloth is bonded to said metal frame by a high temperature adhesive.

7. A vibrating screen assembly as set forth in claim 6 wherein said high temperature adhesive is epoxy.

8. A vibrating screen assembly as set forth in claim 1 wherein urethane is juxtaposed between said screen cloth and said metal frame.

9. A vibrating screen assembly as set forth in claim 1 including two said screen cloths, an upper screen cloth and a lower screen cloth, each said screen cloth being bonded to said frame.

10. A vibrating screen assembly as set forth in claim 1 wherein each said screen cloth is bonded to said frame under tension.

11. A vibrating screen assembly of dissimilar materials, which comprises:

a frame of a first material having a coefficient of thermal expansion;

at least one screen cloth of a second material having a coefficient of thermal expansion, said screen cloth secured to said frame;

wherein the ratio of said coefficient of thermal expansion of said first material to said coefficient of thermal expansion of said second material greater than one;

wherein said frame includes a pair of tubular sides, a pair of tubular ends, a plurality of tubular cross members extending between said sides, wherein side said cross members are connected by a plurality of rods; and wherein the distance between said cross members and the distance between said rods forms a ratio from 0.1 to 1.0.

12. A vibrating screen assembly as set forth in claim 11 where said frame is aluminum.

13. A vibrating screen assembly as set forth in claim 11 wherein said screen cloth is stainless steel.

14. A vibrating screen assembly as set forth in claim 11 wherein said frame has corner gussets joining said sides and said ends.

15. A vibrating screen assembly as set forth in claim 11 wherein each said screen cloth is secured to said frame under tension.

16. A method of manufacturing a vibrating screen assembly, which comprises:

assembling a frame of a first material having a coefficient of thermal expansion, said frame including a pair of sides and a pair of ends wherein said frame includes a pair of tubular sides, a pair of tubular ends, a plurality of tubular cross members extending between said sides, wherein side said cross members are connected by a plurality of rods;

wherein the distance between said cross members and the distance between said rods forms a ratio from 0.1 to 1.0;

placing a high temperature adhesive on said frame;

tensioning at least one screen cloth composed of a second material having a coefficient of thermal expansion less than said frame; and adhesively securing said screen cloth to said frame.

17. A method of manufacturing a vibrating screen assembly as set forth in claim 16 wherein said step of placing a high temperature adhesive on said frame includes epoxy placed on said frame.

18. A method of manufacturing a vibrating screen assembly as set forth in claim 16 wherein said tensioning at least one screen cloth is performed in a jig which is clamped on said at least one screen cloth and then lowered on to said frame and said adhesive.

19. A method of manufacturing a vibrating screen assembly, which comprises:

molding a frame of a first material having coefficient of thermal expansion, wherein said frame includes a pair of tubular sides, a pair of tubular ends, a plurality of tubular cross members extending between said sides, wherein side said cross members are connected by a plurality of rods;

wherein the distance between said cross members and the distance between said rods forms a ratio from 0.1 to 1.0;

tensioning at least one screen cloth composed of a second material having a coefficient of thermal expansion less than said frame;

placing a high temperature adhesive on said frame; and adhesively securing said screen cloth to said frame.

* * * * *